US006877288B2

(12) United States Patent
Shirota

(10) Patent No.: US 6,877,288 B2
(45) Date of Patent: Apr. 12, 2005

(54) WATERPROOF-SHEET TYPE OF ROOFING SHINGLE

(76) Inventor: Muneyasu Shirota, 2-39-2, Nakama, Urasoe-shi, Okinawa, 901-2103 (JP)

( * ) Notice: Subject to any disclaimer, the term of this patent is extended or adjusted under 35 U.S.C. 154(b) by 0 days.

(21) Appl. No.: 10/171,609

(22) Filed: Jun. 17, 2002

(65) Prior Publication Data

US 2003/0230040 A1 Dec. 18, 2003

(51) Int. Cl.[7] ..... E04B 2/00

(52) U.S. Cl. ..... 52/416; 52/302.1; 52/409; 52/518; 52/302.3; 52/411; 52/412; 52/450; 52/453

(58) Field of Search ..... 52/302.1, 409, 52/518, 302.3, 411, 412, 450, 453, 302.2

(56) References Cited

U.S. PATENT DOCUMENTS 2,133,854 A * 10/1938 Fischer ..... 52/560
2,168,218 A * 8/1939 Kirschbraun ..... 52/560
3,625,134 A * 12/1971 Smith ..... 454/365
4,280,399 A * 7/1981 Cunning ..... 454/365
4,514,947 A * 5/1985 Grail ..... 525/36
4,558,637 A * 12/1985 Mason ..... 454/365
4,676,147 A * 6/1987 Mankowski ..... 454/365
4,907,499 A * 3/1990 James ..... 454/365
5,174,076 A * 12/1992 Schiedegger et al. ..... 52/199
5,295,339 A * 3/1994 Manner ..... 52/518
5,295,430 A * 3/1994 Dewald et al. ..... 92/165 R
5,502,940 A * 4/1996 Fifield ..... 52/309.12
5,630,305 A * 5/1997 Hlasnicek ..... 52/518
5,676,597 A * 10/1997 Bettoli et al. ..... 454/365
5,711,126 A * 1/1998 Wells ..... 52/519
5,946,862 A * 9/1999 Hoffman ..... 52/58
6,125,602 A * 10/2000 Freiborg et al. ..... 52/560
6,164,034 A * 12/2000 Roetheli et al. ..... 52/560
6,298,613 B1 * 10/2001 Coulton et al. ..... 52/199
6,418,692 B1 * 7/2002 Freshwater et al. ..... 52/553
6,530,189 B2 * 3/2003 Freshwater et al. ..... 52/553

* cited by examiner

*Primary Examiner*—Carl D. Friedman
*Assistant Examiner*—Christy Green
(74) *Attorney, Agent, or Firm*—Dennison, Schultz, Dougherty & MacDonald

(57) ABSTRACT

A waterproof-sheet type of roofing shingle comprises a belt-like tape attached to a bottom side of the roofing shingle facing a concrete slab. The belt-like tape has air passages for reducing a pressure of steam or vapor generated from concrete. The air passages are formed by projections or grooves and adapted to be in communication with air passages of an adjacent roofing shingle. The air passages are eventually in communication with an ambient atmosphere so as to vent the steam or vapor to the atmosphere, and therefore, bulging of waterproofing material is prevented from occurring.

8 Claims, 10 Drawing Sheets

WATERPROOF-SHEET TYPE OF ROOFING SHINGLE

BACKGROUND OF THE INVENTION

1. Field of the Invention

The present invention relates to a waterproof-sheet type of roofing shingle, and more particularly, to such a roofing shingle which can prevent bulging of waterproofing material overlying on a concrete substrate even in a tropical climate region, such as Okinawa region.

2. Description of the Prior Art

A single-layer type of non-walkable exposed waterproof sheets is known in the art, which is installed on a roof in a step of waterproofing work during construction. Such a waterproof sheet, Gum Cool Cap Ex having a thickness of 3.5 mm which is manufactured by TAJIMA ROOFING Co., Ltd., is normally attached onto a concrete substrate, such as a concrete slab. In general, each of such waterproof sheets is formed in a strip having a width of one meter and a length of eight meters. Such strips are applicable to various types of roofs, such as a large-sized flat roof of a concrete or steel structure building and a sloped roof of a wooden building or the like. In this specification, the term reading "single-layer type" of "waterproof sheet" is intended to be a waterproof sheet which can be attached directly on a roof substrate such as concrete slab, so as to form a substantially single waterproof layer or a single sheet made of integrated waterproof layers.

However, such a non-walkable exposed waterproof sheet necessarily raises a problem involved in bulging of its surface, since it is applied on the concrete substrate in intimate contact therewith. Such a problem often happens particularly in a tropical region, such as Okinawa region. This is mainly because a quantity of vapor or steam generated from the concrete is accumulated or stored between the waterproof layer and the concrete substrate when the waterproof layer on the entire roof is subjected to intensive solar heat, and the pressure of vapor or steam beneath the waterproof layer causes the waterproof layer to be expanded or bulged. Such an expansion or bulging of waterproof layer degrades or deteriorates the waterproofing performance and appearance of roof, and therefore, an approach for overcoming this problem is required.

SUMMARY OF THE INVENTION

It is therefore an object of the present invention to provide a waterproof-sheet type of roofing shingle which prevents leakage of rain and bulging of waterproof layer, even though it is installed on a roof in a tropical region.

To this end, the present invention provides a waterproof-sheet type of roofing shingle comprising a belt-like tape attached to a bottom side of the roofing shingle facing a roof substrate, the belt-like tape having air passage means for reducing a pressure of steam or vapor generated from the roof substrate, the air passage means being adapted to be in communication with the air passage means of an adjacent roofing shingle, whereby said air passage means is eventually in communication with an ambient atmosphere so as to vent said steam or vapor to the atmosphere.

The air passage means may be formed by projections or grooves which extend in a longitudinal direction of the belt-like tape.

In such an arrangement, air passages 41A as shown in FIG. 4 are formed between the concrete substrate and roofing shingles BX. Expansion air between the concrete substrate and the roofing shingles BX externally escapes through the passage means to the atmosphere, when the roof is subjected to solar heat. The provision of air passage means enables ventilation of steam or vapor leaving the roof substrate, and this prevents bulging of waterproofing material from occurring.

DETAILED DESCRIPTION OF THE EMBODIMENT

Preferred embodiments of a waterproof-sheet type of roofing shingle according to the present invention will now be described with reference to the drawings. The waterproof sheet used in the following embodiments may be of a single-layer type including various facing materials on its exposed surface. Such a waterproof sheet is preferably GUM COOL CAP EX having a thickness of 3.5 mm, manufactured by TAJIMA ROOFING Co., Ltd.

(1) First Embodiment

A first embodiment of the present invention relates to a waterproof-sheet type of roofing shingle which can be installed on to an upper surface of a sloped roof, e.g., gable roof.

Figure 1A:
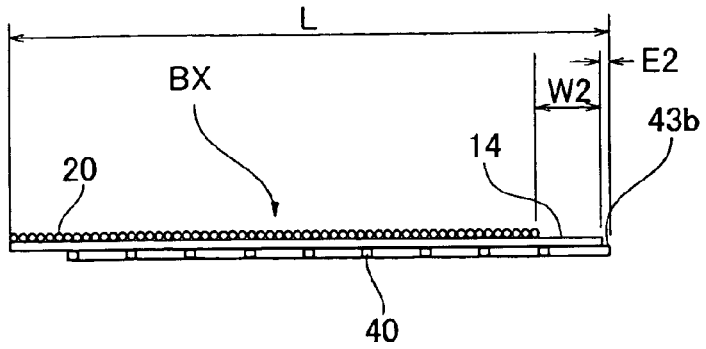
FIG. 1 shows a plan view, side elevational views and enlarged cross-sectional view of a waterproof-sheet type of roofing shingle according to the first embodiment of the present invention.
Figure 1B:
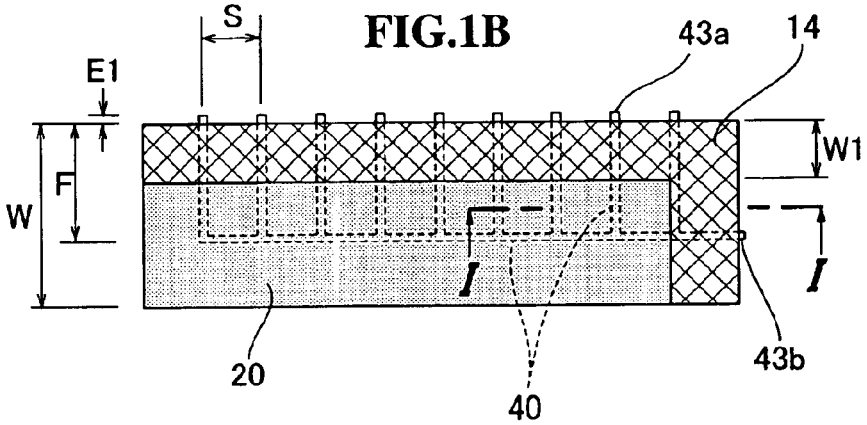
Figure 1C:
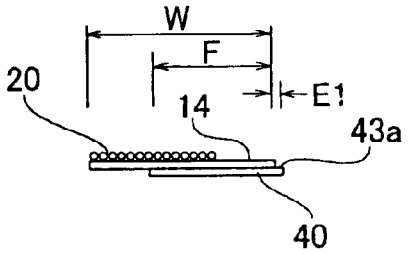
Figure 1D:
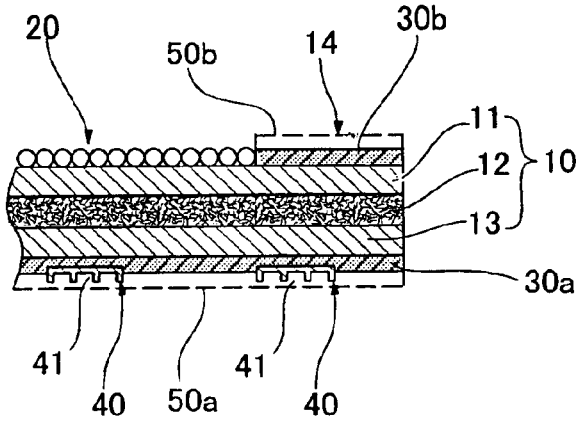
Figure 2:
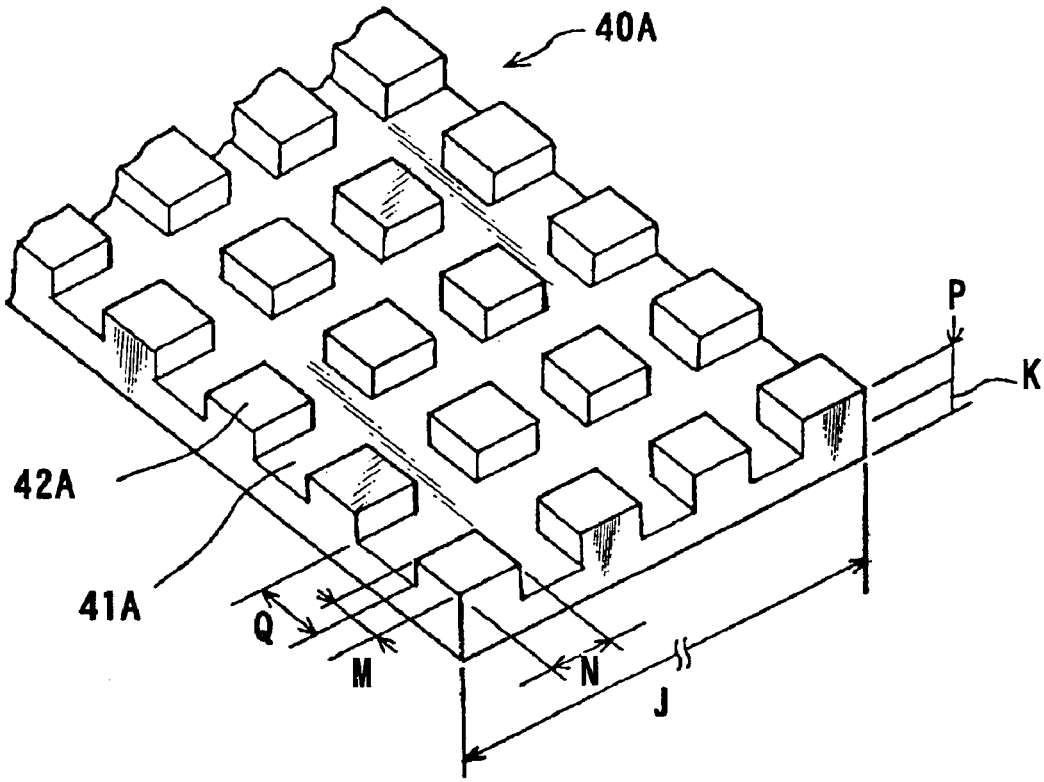
FIG. 2 shows a perspective view of a waterproof tape with air passages which is shown in FIG. 1.

FIGS. 1A, 1B and 1C shows plan and side elevational views of a waterproof-sheet type of roofing shingle BX in the first embodiment; FIG. 1D shows an enlarged cross-sectional view of the roofing shingle, taken along line I—I shown in FIG. 1B; FIG. 2 shows a perspective view of a waterproof tape which has air passages in a lattice pattern as a first example of air passage means; and FIG. 3 shows plan and side elevational views of the roofing shingles which have been installed on the roof.

Referring to FIGS. 1A and B, the waterproof-sheet type of roofing shingle BX is formed in a rectangular configuration having 1 m in length (L) and 30 cm in width (W), and comprises primary waterproof layers 10, an exposed surface portion 20 on which sand grains are attached or applied, a bottom adhesive layer 30*a* with an adhesive material to be adhered onto a concrete substrate, waterproof tapes 40, each having air passages formed thereon as described hereinafter, and a releasable backing paper 50*a* covering the layer 30*a*.

The primary waterproof layers 10 comprises an upper improved- or modified-asphalt layer of exposed type 11, a nonwoven cloth of synthetic fibers 12, a lower modified-asphalt layer 13 and an overlap margin 14, which is used for partially overlapping or superimposing adjacent waterproof sheets one on another as shown in FIG. 3. The overlap margin 14 is covered with a top adhesive layer 30*b* and the layer 30*b* is covered with a top releasable paper 50*b*, similarly to the layer 30*a*. The overlap margin 14 has a L-shaped formation, one part thereof extending along the longer or upper side of the roofing shingle BX and the other part extending the shorter or right edge thereof. The respective parts are 10 cm in width (W1:W2). Although the primary waterproof layers 10 are made by modified asphalt materials in the illustrated embodiment, they may be formed by any other suitable materials, such as sheets of synthetic rubber or synthetic resin.

The releasable paper 50*a* functions so as to improve efficiency or workability of installation work, and transportability and storability of the roofing shingle BX, and it is separated from the waterproof layers 10 immediately before the installation work of shingle BX on the roof is carried out.

The waterproof tape 40 has air passages 41 formed on the bottom side facing the concrete substrate. Various examples of the waterproof tape 40 will be described hereinbelow.

First Example of Waterproof Tape

FIG. 2 partially shows the first example of the waterproof tape 40A having the air passages in a lattice formation.

For instance, the waterproof tape 40A is formed by foamed polyethylene resin, and its entire width J is set to be in a range between 15 mm and 20 mm and its thickness K in a range between 1 mm and 2 mm. The waterproof tape 40A includes square projections 42A arranged thereon in a tessellated pattern, so that air passages or airways 41A are defined between the projections 42A. Each of the projections has dimensions M, N which are, for instance, 2 mm and 2 mm, and the air passage 41A formed between adjacent projections has a depth P, for instance, 1 mm, spaced apart a distance Q, for instance, 2 mm from each other.

The waterproof tape 40A functions in such a manner that, when the roofing shingle is placed and adhered on a concrete substrate, expansion air can easily or effectively escape or leak to the atmosphere through the air passages 41A in the lattice formation, as described hereinafter with reference to FIG. 5.

The waterproof tapes 40A are attached to the adhesive layer 30*a* of the roofing shingle BX with the air passages 41A facing the concrete substrate, as shown in FIGS. 1A and 1B. For instance, nine pieces of the longitudinal waterproof tapes 40A, each having a length F of about 200 mm, are arranged on the bottom side of the roofing shingle BX in parallel rows, spaced a distance of approximately 100 mm (S) from each other. Each of the waterproof tapes 40A has an upward extension 43*a* extending from the top edge thereof (E1). The upward extensions 43*a* function to form air passages between adjacent roofing shingles BX which are successively placed on the roof as shown in FIG. 3. The function of the upward extension 43*a* in the waterproof tape 40A is described in detail hereinafter with reference to FIG. 5.

The transverse waterproof tapes 40A with the air passages has a length of approximately 900 mm, and a rightward extension 43*b* extends from the right side thereof (E2). The extension 43*b* functions in substantially the same manner as that of the extension 43*a*.

Figure 3A:
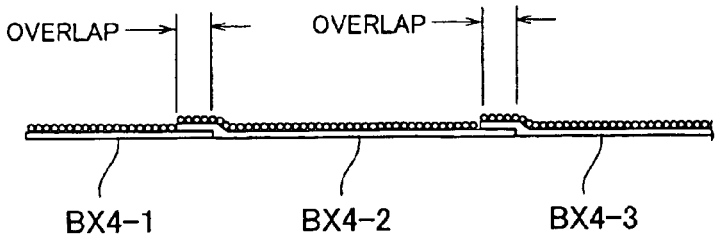
FIG. 3 shows a plan view and side elevational views of the waterproof-sheet type of roofing shingles, which are successively installed on a roof.
Figure 3B:
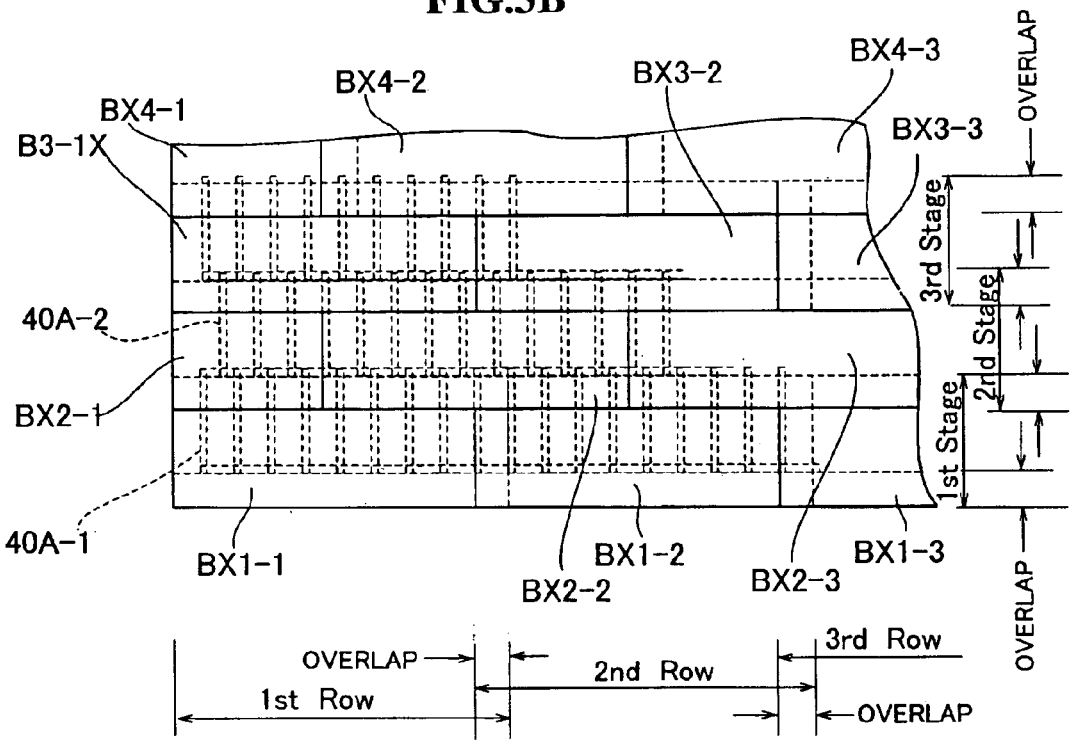
Figure 3C:
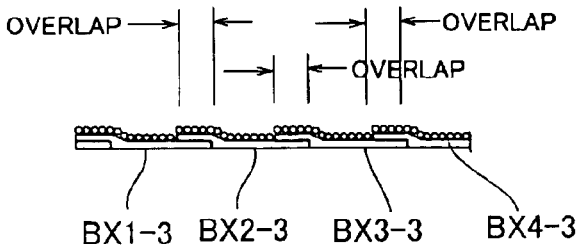
Figure 4A:
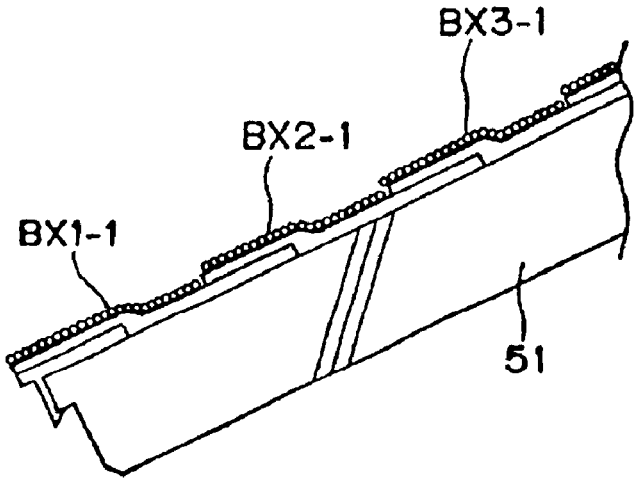
FIG. 4A shows a partial cross-sectional view of the roof shown in FIG. 3
Figure 4B:
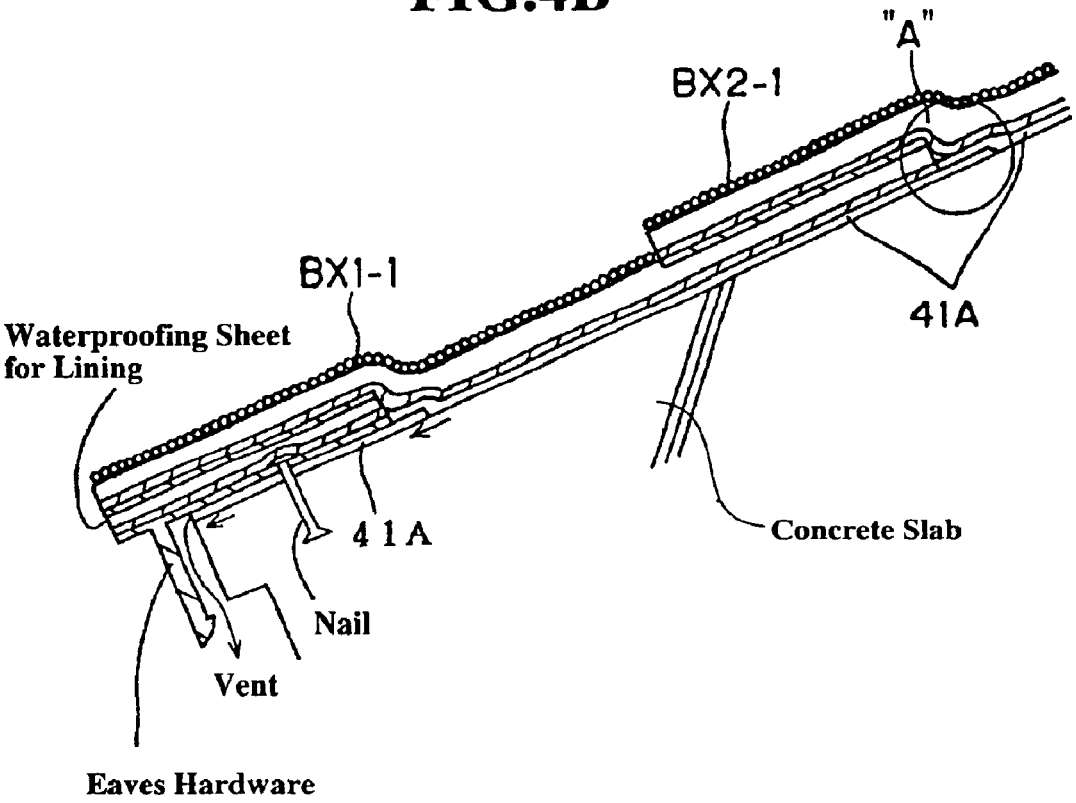
FIG. 4B shows a cross-sectional view illustrating a path through which expanded air is exhausted to the atmosphere.

The steps of installing the aforementioned roofing shingles BX on a roof is described below, with reference to FIGS. 1–6. FIGS. 3A to 3C show a plan and side elevational views of the roofing shingles BX placed on the roof; FIG. 4A shows a cross-sectional view of the roof on which the roofing shingles BX are placed; FIG. 4B shows an enlarged cross-sectional view illustrating a ventilation route of air passages formed by the partially overlapped roofing shingles BX; FIG. 5 shows a conceptive view illustrating the ventilation routes for expansion air; and FIG. 6 shows a roofing shingle BX without a waterproof tape thereon.

Referring now to FIGS. 3 and 4, the roofing shingle BX1-1 of first row and first stage is, for a start, attached to the roof at a left and lower position as viewed in FIG. 3B, with the waterproof tape 40A thereof facing a slab concrete (concrete substrate) 51. The roofing shingle BX1-1 is oriented transversely.

The second roofing shingle BX1-2 of second row and first stage is then attached to the roof at a position adjacent to the first roofing shingle BX1-1 with the overlap margins 14 of the shingles BX1-1, BX1-2 overlapping with each other. Similarly, the roofing shingles BX1 of the first stage are successively installed on the roof toward the horizontal and rightward direction.

The first roofing shingle BX2-1 of first row and second stage is then attached to the roof with the overlap margin 14 thereof overlapping that of the roofing shingle BX1-1 of the first stage. The waterproof tape 40A-1 of the first roofing shingle BX1-1 of the first stage is in an offset position with respect to the waterproof tape 40A-2 of the roofing shingle BX2-1 of the second stage, as shown in FIG. 3, and the air passages 41A are in communication with each other in a section as indicated by reference numeral "A" in FIG. 4B.

Figure 5:
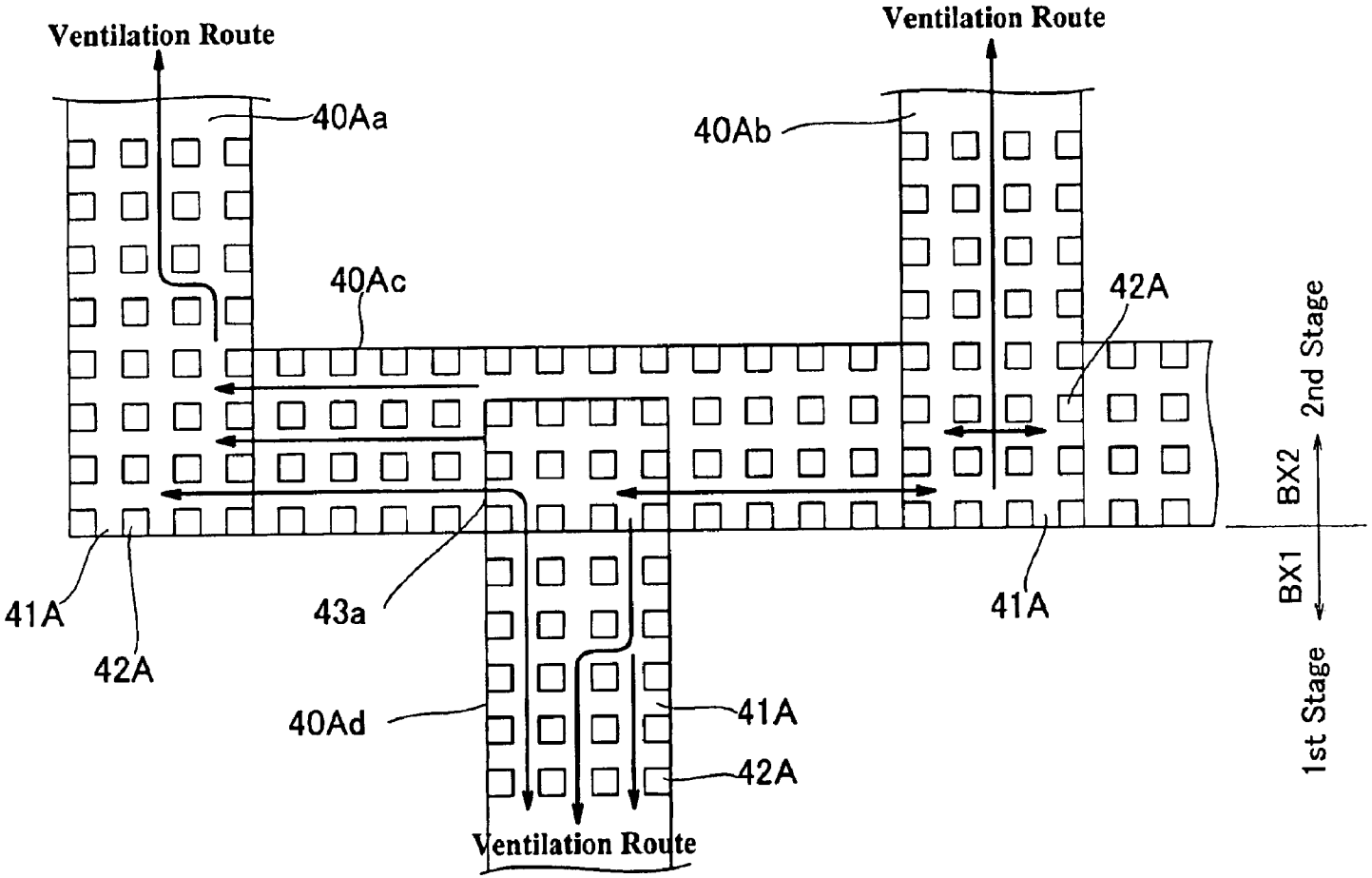
FIG. 5 shows a plan view illustrating a concept of the ventilation routes between the respective waterproof tapes.
Figure 6A:
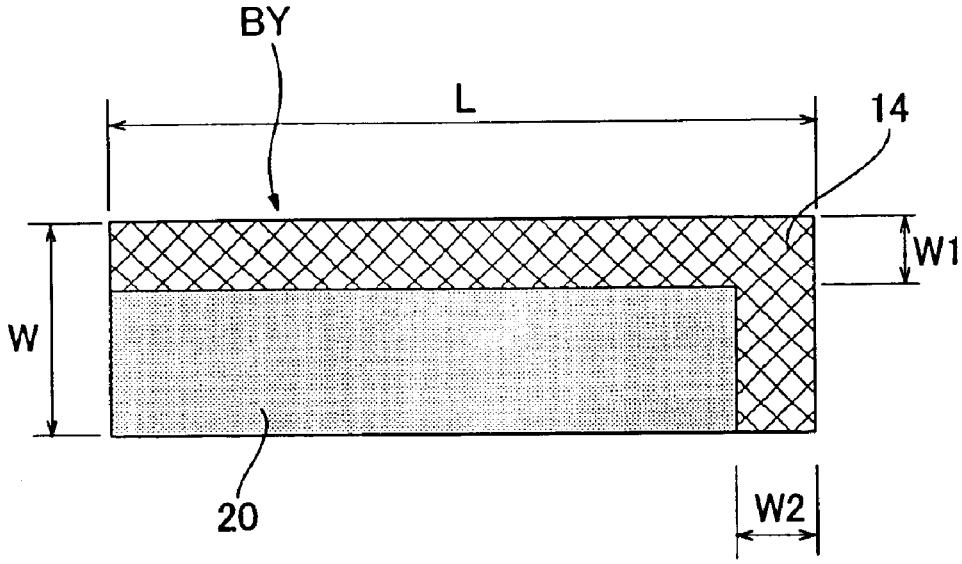
FIG. 6 shows plan and side elevational views illustrating the roofing shingle which does not have a waterproof tape.
Figure 6B:
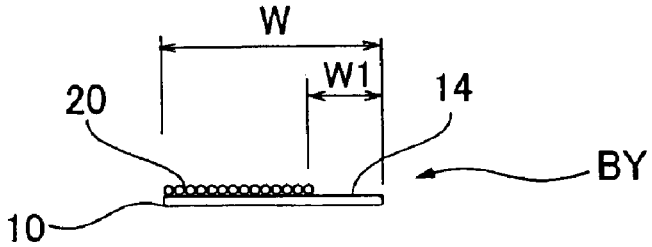

As shown in FIG. 5, the transverse waterproof tape 40Ac is provided between adjacent waterproof tapes 40Aa and 40Ab of the waterproof sheet BX2. A plurality of ventilation routes (air passages) are formed as shown by arrows such that expansion air flows through the waterproof tape 40Ac between the waterproof tapes 40Aa and 40Ab so as to disperse and reduce the pressure of vapor or steam leaving the concrete substrate.

Further, the extension 43*a* of the first waterproof tape 40Ad overlaps the substantially central portion of the waterproof tape 40Ac, the expanded air flows between the waterproof tapes 40Ad and 40Ac as shown by arrows, so that the ventilation routes are formed between the three waterproof tapes 40Aa, 40Ab and 40Ad. Thus, the air passages are provided which continue over junctions of the tapes 40Aa, 40Ab, 40Ac and 40Ad, and therefore, the expanded air including the vapor or steam from the concrete can be eventually exhausted through the eaves flashing hardware of the roof as shown by arrow in FIG. 4B, after it has passed through the ventilation routes 41A over the waterproof tapes 40. Even though the roof is subjected to intensive solar heat, the waterproof sheets can avoid bulging of waterproofing materials.

As is apparent from the foregoing description, the roofing shingles BX are successively attached to the other type of roof in the same way of installation.

The ventilation routes may be in communication with the atmosphere on both sides, e.g., along the eaves edge and the ridge. As is understandable for those skilled in the art, the ventilation routes have to be in communication with the atmosphere on at least one side, e.g., the eaves end portion or the ridge portion. In a case where the side ventilation routes are in communication with the atmosphere along the eaves end portion, a roofing shingle BY as shown in FIG. 6 may be used in the ridge portion. On the other hand, if the ventilation routes are in communication with the atmosphere along the ridge portion, the roofing shingle BY may be used in the eaves end portion. In these cases, the roofing shingle BY may be also used along verge (or barge course) of the roof.

The roofing shingle BY generally has a structure similar to the roofing shingle BX, except that it does not have a waterproof tape applied thereon. If the roofing shingles BX with the waterproof tapes 40 are used for the verge of the roof, rain water or the like is apt to enter the inside of the roof. In order to avoid such a condition, the roofing shingle BY without the waterproof tape 40 is preferably used for the verge or similar parts of the roof.

Second Example of Waterproof Tape

Figure 7A:
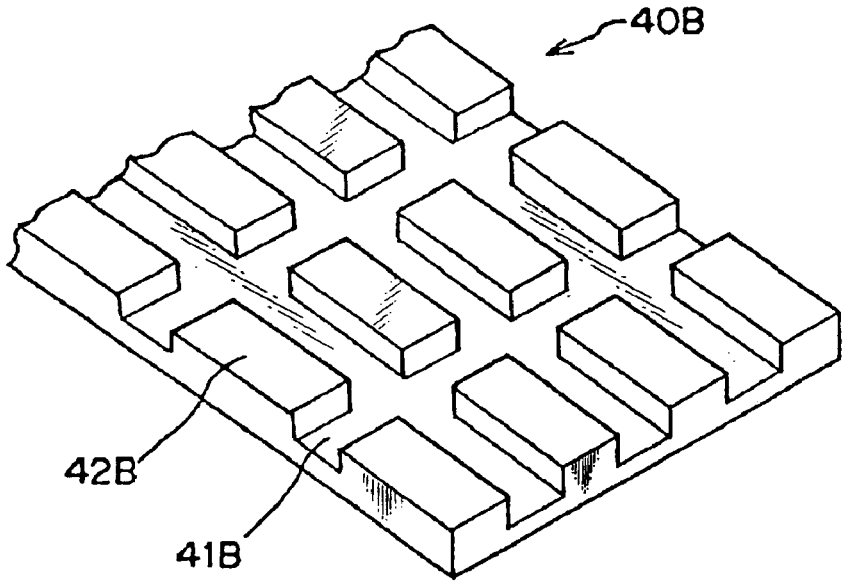
FIGS. 7A and 7B show the second and third examples of the waterproof tape.

FIG. 7A shows another example of waterproof tape 40B which has rectangular projections 42B and air passages 41B in a lattice formation. The second example of waterproof tape 40B merely differs from the first example in the profile of projection 42B and the spaced distance of the air passages 41B.

Third Example of Waterproof Tape

Figure 7B:
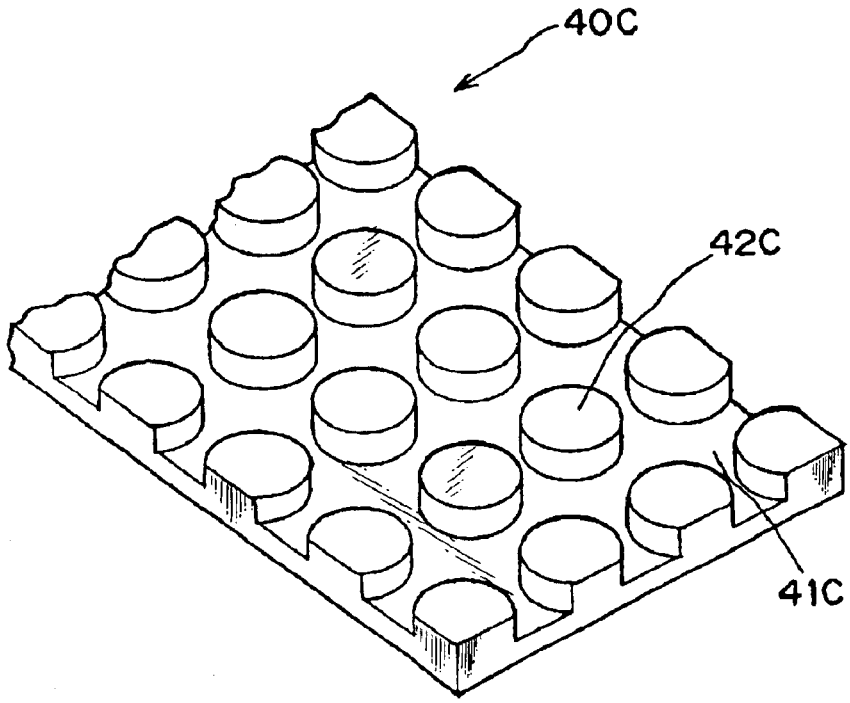

FIG. 7B shows still another example of waterproof tape 40C wherein it has stub-shaped projections 42C and air passages 41C formed therebetween. The third example of the waterproof tape 40C differs from the first example in the profile of the projection 42C and the cross-section of the air passage 41C.

Fourth Example of Waterproof Tape

Figure 8A:
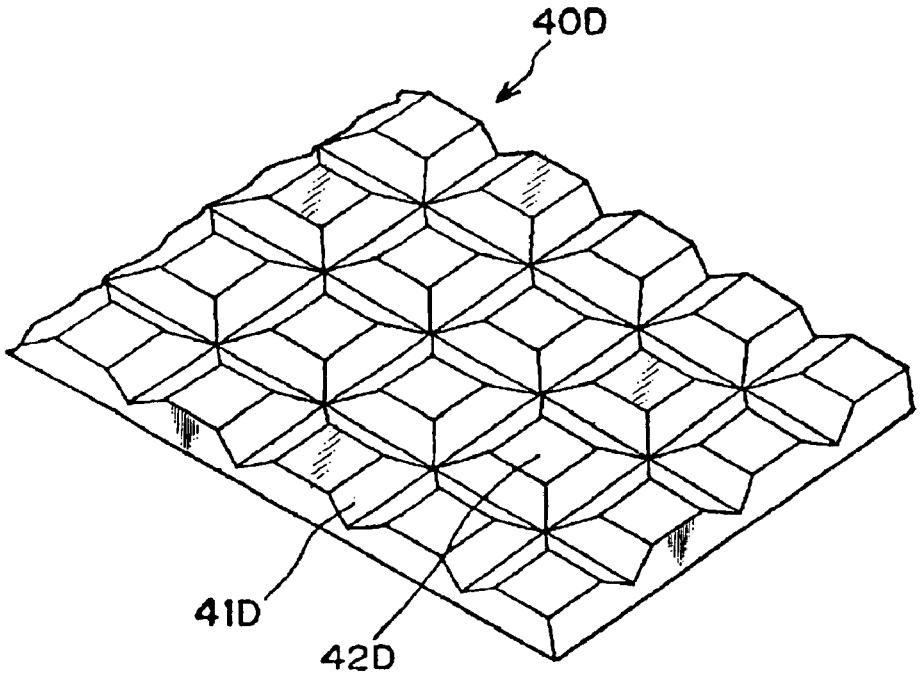
FIGS. 8A and 8B show the fourth and fifth examples of the waterproof tape.

FIG. 8A shows the forth example of waterproof tape 40D wherein it has air passages 41D. The fourth example of the waterproof tape 40D differs from the first example only in that the tape 40D has frusto-pyramid-shaped projections 42D and the air passages 41D formed therebetween.

Fifth Example of Waterproof Tape

Figure 8B:
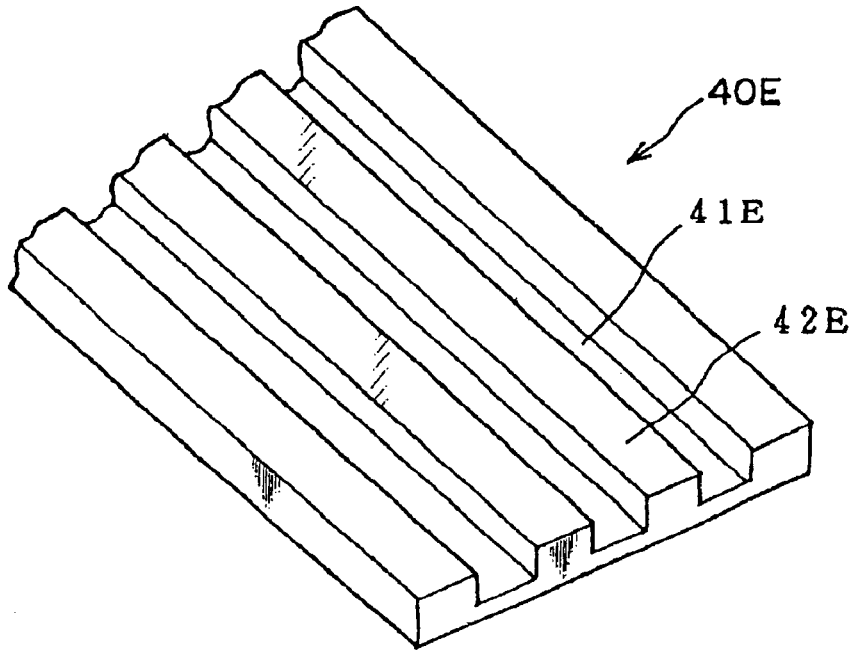

FIG. 8B shows a waterproof tape 40E having groove-shaped air passages 41E formed therein.

The fifth example of the waterproof tape 40E differs from the first example in that the tape 40E has partitions 42E which extend parallel to each other in a longitudinal direction of the tape so as to form parallel air passages 41E. This arrangement of waterproof tape 40E is suitable for use in construction of a flat walkable roof. This is because the partitions 42E are continuously in contact with the concrete substrate to increase the strength against a live load on the roof. The air passages 41E are not collapsed even if a heavy load, such as a walker's weight, is exerted thereto.

If the roofing shingle is installed as a walkable roof, the adhesive of the adhesive portion is pressed and forced to enter the air passages 41E when a heavy load is exerted on the shingle. The provision of the partitions preferably prevents the adhesive from entering the grooves and ensures the cross-section of each air passage.

On the contrary, the aforementioned first to fourth examples of waterproof tape are preferably employed in the non-walkable type of exposed waterproof sheets in which a heavy load is not exerted on the waterproof layers and therefore, in these examples, the longitudinal and transversal grooves (or depressions) are formed to improve the ventilation effect.

(2) Second Embodiment

Figure 9A:
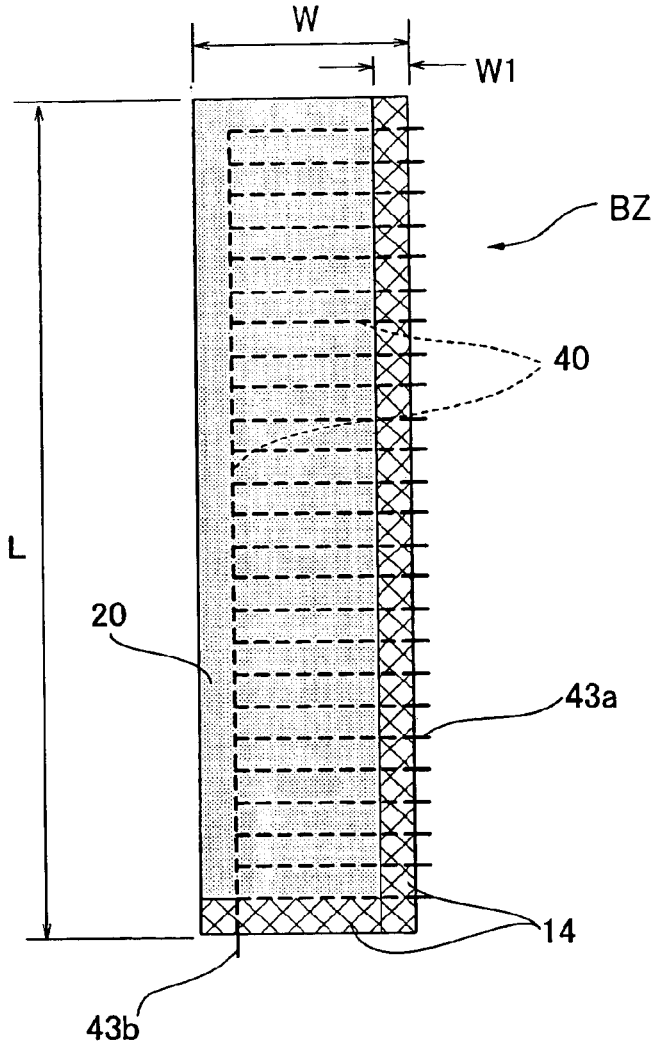
FIG. 9 shows plan and side elevational views illustrating the second embodiment of the present invention.
Figure 9B:
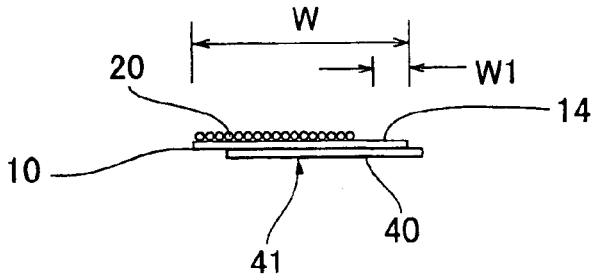
Figure 10:
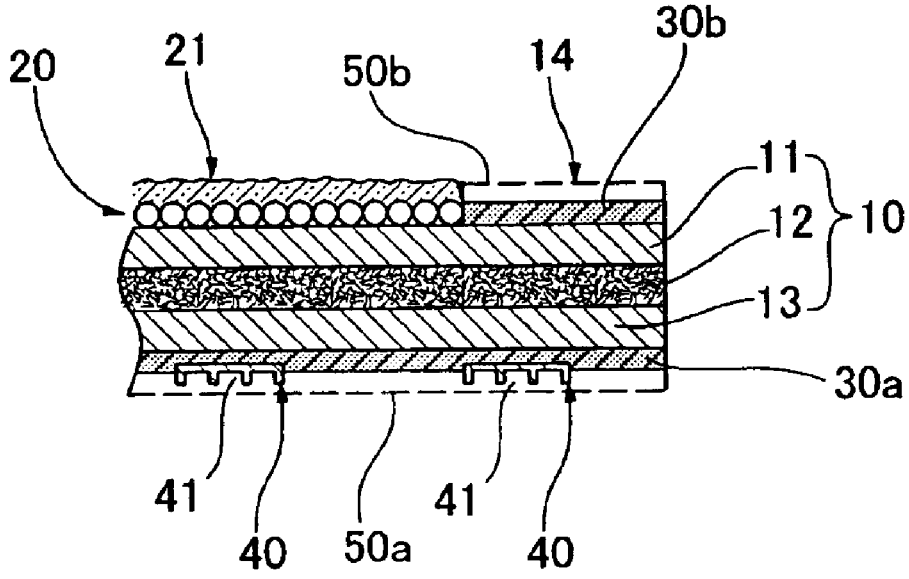
FIG. 10 shows an enlarged cross-sectional view of a modified roofing shingle usable in the first and second embodiments.

Although the first embodiment has been described in relation to use of a roofing shingle of 1 m long×30 cm wide for a sloped roof, the second embodiment as shown in FIG. 9 relates to a roofing shingle of 8 m in length and 1 m in width for a flat roof. The roofing shingle comprises a primary waterproof layer 10, an exposed portion 20, an adhesive layer 30*a*, waterproof tapes 40 and a releasable paper 50*a*. These elements are substantially the same as those of the first embodiment. The second embodiment is applied to an exposed single-layer waterproof sheet suitable for use in a flat roof.

As shown in FIG. 9, the waterproof sheet BZ has waterproof tapes 40 attached to the back side thereof and horizontally arranged parallel to one another, spaced a distance of about 10 cm, and a single waterproof tape 40 attached to the back side in a longitudinal direction.

(3) Modifications

The first and second embodiments have been described as to the waterproof sheet type of roofing shingle having its exposed portion formed by the synthetic resin or rubber sheet, or coated with sand grains. However, the exposed portion 20 may be additionally coated with a fire-proofing paint or a finishing paint 21.

Although the embodiments and modifications have been described as to the "exposed single-layer" waterproof sheet type of roofing shingle, the present invention may be similarly applied to a lining or backing sheet having the band-like tapes (waterproof tapes) with the air passage means attached thereto. In such a case, the lining or backing sheet with the waterproof tapes is installed on the concrete substrate, and thereafter, a waterproofing material, such as a non-walkable exposed single-layer type of waterproof sheet, is overlaid on the lining or backing sheet.

Effects or Advantages to be Obtained from the Present Invention

The present invention can provide the following advantages:

i). Bulging is prevented from occurring in the exposed waterproof roof layer, the waterproof layer is improved in its quality and durability, and works for maintenance and repair can be relieved.

ii). Since the roofing shingle of the present invention is in the form of a single layer structure, the number of working steps is reduced and the efficiency of installation work is improved. A period of construction work, material costs and labor costs required for constructing a roof can be reduced, and in addition, the dead load on the roof can be reduced in weight.

iii). Since the bulging is avoidable, the roofing shingle may be applied to any one of various roof types, such as arc, dome, curved, sloped roof types.

iv). Since the roofing shingle has a weight less than conventional tiles and slates, costs involved in moving, handling or lifting works can be reduced.

v). The roofing shingle can surely prevent a leakage of water.

vi). Owing to improvement of waterproofing performance and sure adhesion of roofing shingles on the roof, maintenance costs for prolonging the life time of waterproofing can be reduced.

What is claimed is:

1. A waterproof-sheet type of roofing shingle comprising:

an exposed surface portion and an overlap portion on which an adjacent roofing shingle is superimposed and adhered by adhesive, a waterproof sheet of the shingle being attached directly on a roof substrate to form a waterproof layer on a roof, the exposed surface portion having a rectangular configuration, the overlap portion being a margin of each of the shingles which extend along two sides of the exposed surface portion, and wherein a pressure of vapor or steam generated from the roof substrate beneath the waterproof layer may cause the waterproof layer to be expanded or bulged and further comprising:

a plurality of belt tapes attached to a bottom side of the roofing shingle facing the roof substrate, the tape having air passage means for reducing the pressure of steam or vapor, the air passage means being in communication with the air passage means of the adjacent roofing shingle, whereby said air passage means is eventually in communication with an ambient atmosphere so as to vent said steam or vapor leaving the roof substrate to the atmosphere for preventing leakage of rain and bulging of the waterproof layer, wherein said air passage means has air passages formed by projections or grooves provided on said tape, the tape is provided with an extension extending outwardly from an edge of the roofing shingle, and the extension overlaps with the tape of the adjacent roofing shingle so that the air passage means is in communication with the air passage means of the adjacent roofing shingle, whereby expansion air between the roof substrate and the roofing shingles externally escapes through the air passage means to the atmosphere, when the roof is subjected to solar heat.

2. The waterproof-sheet type of roofing shingle according to claim 1, wherein said air passages are formed between said projections, and said passages extend in a longitudinal direction of said tape.

3. The waterproof-sheet type of roofing shingle according to claim 1, wherein said air passage means has the parallel grooves formed in said tape, and said grooves constitute air passages extending in a longitudinal direction of said tape.

4. The waterproof-sheet type of roofing shingle according to claim 1, wherein said bottom side of the roofing shingle is provided with an adhesive layer, to which said tape is adhered.

5. The waterproof-sheet type of roofing shingle according to claim 1, wherein said tape is positioned to extend in longitudinal and transverse directions of the roofing shingle, and said air passage means continues over a junction of a longitudinal portion of the tape and transverse portion of the tape.

6. The waterproof-sheet type of roofing shingle according to claim 1, wherein said exposed surface portion is a coat of sand grains, a synthetic resin sheet or a rubber sheet.

7. The waterproof-sheet type of roofing shingle according to claim 6, wherein said exposed surface portion has a rectangular configuration and said overlap portion extends along two sides of the rectangular exposed surface portion to form an L-shaped overlap margin on which said adjacent roofing shingle is superimposed and adhered by said adhesive.

8. The waterproof-sheet type of roofing shingle according to claim 1, wherein the roofing shingle is used as a lining sheet attached to the roof substrate, and a roofing material is further attached on the roofing shingle.

* * * * *